US006218787B1

(12) United States Patent
Murcko et al.

(10) Patent No.: US 6,218,787 B1
(45) **Date of Patent: *Apr. 17, 2001**

(54) REMOTE DIMMING CONTROL SYSTEM FOR A FLUORESCENT BALLAST UTILIZING EXISTING BUILDING WIRING

(75) Inventors: Robert M. Murcko, Binghamton; Robert H. Katyl, Vestal; David W. Dranchak, Endwell, all of NY (US)

(73) Assignee: JRS Technology Inc., Endicott, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/063,325

(22) Filed: Apr. 20, 1998

(51) Int. Cl.[7] ..... H05B 37/02
(52) U.S. Cl. ..... 315/194; 315/291; 315/DIG. 4
(58) Field of Search ..... 315/291, 194, 315/DIG. 5, DIG. 4

(56) References Cited

U.S. PATENT DOCUMENTS

| | | | |
|---|---|---|---|
| 4,876,498 | 10/1989 | Luchaco et al. . | |
| 4,954,768 | 9/1990 | Luchaco et al. . | |
| 5,055,746 | 10/1991 | Hu et al. . | |
| 5,068,576 | 11/1991 | Hu et al. . | |
| 5,107,184 | 4/1992 | Hu et al. . | |
| 5,675,221 | 10/1997 | Yoo et al. . | |
| 5,691,605 | 11/1997 | Xia et al. . | |
| 5,872,429 * | 2/1999 | Xia et al. | 315/294 |

* cited by examiner

*Primary Examiner*—David Vu
(74) *Attorney, Agent, or Firm*—Salzman & Levy

(57) ABSTRACT

A system is described for remotely controlling the dimming level of ballasts for fluorescent lamps through standard two-wire AC power wiring normally used within buildings. The system makes use of a unique dimming control that creates a small positive-negative voltage asymmetry, or DC offset, and encodes this control signal onto the power lines that supply the ballasts to be dimmed. The control unit can be integrated with a wall switch as part of a variable dimming control to supply "local" remote control. It can be interfaced to a building control computer. A small decoding module preferably located in the lighting fixture near the ballast recovers the control signal from the applied asymmetry of the power voltage, processes it if necessary, and feeds it to the ballast. To minimize power losses in the dimming control, a DC offset of zero volts, or no asymmetry, produces full light output. For full dimming, an offset of about 15 volts is used. The resulting maximum dissipation is only a few watts when dimming up to six, 32-watt fluorescent lamps. The advantages include savings in re-wiring costs, higher power factor levels, lower harmonic distortion and lower radio frequency interference compared to other two-wire dimming methods.

12 Claims, 10 Drawing Sheets

REMOTE DIMMING CONTROL SYSTEM FOR A FLUORESCENT BALLAST UTILIZING EXISTING BUILDING WIRING

FIELD OF THE INVENTION

The present invention relates to an electronic system for dimming fluorescent lamps and, more particularly, to a control system which utilizes existing building wiring to transmit dimming control signals to an electronic ballast for use in a fluorescent lighting system.

BACKGROUND OF THE INVENTION

Lighting applications account for about 30% of the electrical energy consumption in the United States. With increasing interest in energy conservation, lighting systems that use less energy and are easy and cost-effective to install are becoming more important. One effective way to reduce energy consumption of lighting is to use dimmable fluorescent lighting systems. Newer lighting systems can control light output and energy consumption by adjustment of lighting levels throughout the day, reducing energy usage when light is not needed. Existing dimmable fluorescent lighting systems require extra, low-voltage control wiring to provide control signals to the ballasts contained within lighting luminaires. The present invention allows the lighting control signals to be sent over the same wiring that is used to provide AC power to the ballasts. By using the existing wiring, the changeover from conventional lighting is greatly simplified and installation costs are significantly reduced.

Presently there are two types of dimmable ballasts for fluorescent lighting. The first type utilizes a phase-controlled thyristor dimming control to reduce the AC current provided to a special lighting ballast. These ballasts respond by creating suitable internal dimming signals that are then used to vary light intensity. This type of ballast can use conventional, two-wire AC power wiring, allowing them to be installed easily. However, the abrupt modulation of the AC line current causes severe distortion, greatly reducing the power factor, and increasing the harmonic content of the line current. This type of ballast, therefore, can introduce significant problems into the power distribution when a significant number of the ballasts are installed within a large building.

The second type of dimming ballast uses separate low-voltage control wiring to provide dimming signals to the ballast. The control voltages are typically DC signals that may vary from 0 volts (fully dimmed) to 10 volts (full brightness). The AC power is handled on separate conventional AC power wiring. Because the control function is separated from the power line, no distortion is introduced by the control system to the AC power, making this type of ballast suitable for use in large installations. The drawback to their use is the added complexity of installation, since the additional low-voltage control wiring is needed.

DISCUSSION OF THE RELATED ART

U.S. Pat. Nos. 4,876,498 and 4,954,768 for TWO-WIRE LOW VOLTAGE DIMMER, issued Oct. 24, 1989 and Sep. 4, 1990, respectively, to David G. Luchaco, et al. describe a dimming control system of the first type described above. Luchaco, et al. teach a low-voltage, two-wire dimming circuit comprising a voltage compensating circuit for regulating the RMS value of an AC voltage applied to a load and a correcting circuit for eliminating DC current that may flow through the load. The desired dimming level is accomplished by varying the phase angle of the applied AC voltage. In contradistinction, the dimming control system of the present invention does not utilize phase control of the AC power line supplying the ballast, but rather encodes dimming control information as a slight asymmetry in the AC waveform without any of the waveform distortion problems described hereinabove. The power factor of the AC supply to even a great number of ballasts is unaffected by the control system of the present invention.

Another prior art ballast control system is described in U.S. Pat. No. 5,107,184 for REMOTE CONTROL OF FLUORESCENT LAMP BALLAST USING POWER FLOW INTERRUPTION CODING WITH MEANS TO MAINTAIN FILAMENT VOLTAGE SUBSTANTIALLY CONSTANT AS THE LAMP VOLTAGE DECREASES, issued Apr. 21, 1992 to Feng-Kang Hu, et al. A dimming ballast system allows the light output of the lamp to be controlled by a remote source. The system encodes the remote control signal by interrupting the current flow to the ballast. On the other hand, the control system of the present invention does not interrupt the current flow to the ballast and, consequently, does not introduce power line distortion and power factor alteration. The control system of the instant invention encodes a DC control signal onto the AC power lines by means of a slight asymmetry of the AC waveform.

U.S. Pat. No. 5,675,221 for APPARATUS AND METHOD FOR TRANSMITTING FORWARD/RECEIVING DIMMING CONTROL SIGNAL AND UP/DOWN ENCODING MANNER USING A COMMON USER POWER LINE; issued Oct. 7, 1997 to Hong K. Yoo et al. describes an apparatus and a method for transmitting a dimming control signal in an up/down encoding manner. The encoded binary data is set as transmission data on the AC power line. The Yoo, et al. system transmits a series of bits at zero-crossing time in the AC waveform. Unlike the Yoo system, the inventive system requires no microcomputer, zero-crossing detector or pulse train generator.

U.S. Pat. No. 5,691,605 for ELECTRONIC BALLAST WITH INTERFACE CIRCUITRY FOR MULTIPLE DIMMING INPUTS, issued Nov. 25, 1997 to Yongping Xia, et al. describes a lamp controller (including a receiver) which receives an input signal and decodes control signals supplied from a transmitting device such as a power line wall controller. The system operates in accordance with at least two of the following communication techniques: phase angle control, step control, and coded control. Each of these control types is subject to the problems described hereinabove. The inventive system, on the other hand, relies on none of these techniques with their attendant problems, but rather utilizes a control signal encoded onto the AC power line by a slight asymmetry in the AC waveshape.

Accordingly, it is an object of the invention to provide a fluorescent lighting system that can simply control the lighting level through signals sent over the conventional two wire AC power wiring of a building.

It is another object of the invention to provide a dimming control that uses minimal power and has a low cost.

It is yet another object of this invention to provide a dimming control system that also allows for the use of standard 0–10 volt dimming electronic ballasts.

It is a still further object of the invention to provide a dimming control system that produces minimal disturbances of the AC power quality by maintaining high power factor and low harmonic distortion of the AC power line current.

It is an additional object of the invention to provide a dimming control system that can offer remote control of a device from more than one location.

It is a still further object of the invention to provide a dimming control system that may be readily integrated into overall building energy management systems.

SUMMARY OF THE INVENTION

The present invention features a new type of control system for a dimmable fluorescent ballast that inserts a slight voltage asymmetry or DC offset into an AC power supply line to an electronic ballast. The asymmetry or offset is inserted only during one half cycle of the power voltage alternation. This asymmetry or DC offset is "transmitted" over the power wiring to the device(s) being controlled where it is decoded by a small circuit module preferably located in the lighting luminaire adjacent to the dimming ballast. A low voltage control signal in the range of approximately the 0–10 volts is derived by the circuit module and is fed to the low voltage control lines of the ballast. According to standard industry practice, at maximum light output the low voltage ballast control signal is set to 10 volts. To minimize power dissipation in the dimmer, the DC offset is required to be zero at maximum lighting levels, so that the full offset is transmitted.

In the embodiment chosen for purposes of disclosure, the DC offset is introduced by a variable voltage reference circuit that emulates a programmable zener diode connected across a bypass diode. The voltage reference produces a given voltage drop of up to 4 volts during one half of the power line alternation cycle. The bypass diode conducts during the other alternation, producing the desired asymmetrical voltage waveform. A simple DC restore circuit at the load end of the wiring recovers the offset. It is then inverted and level-shifted to the voltage swing required by the ballast control input. The actual ballast drive is generated by an open emitter voltage follower, as the control input of a dimmable ballast is a clamped current source. With this type of circuit architecture, power dissipation is minimized over that which would occur if the standard 0–10 volt swing itself were used as the asymmetry or DC offset to be transmitted over the wiring to the lighting fixture.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

Figure 1:
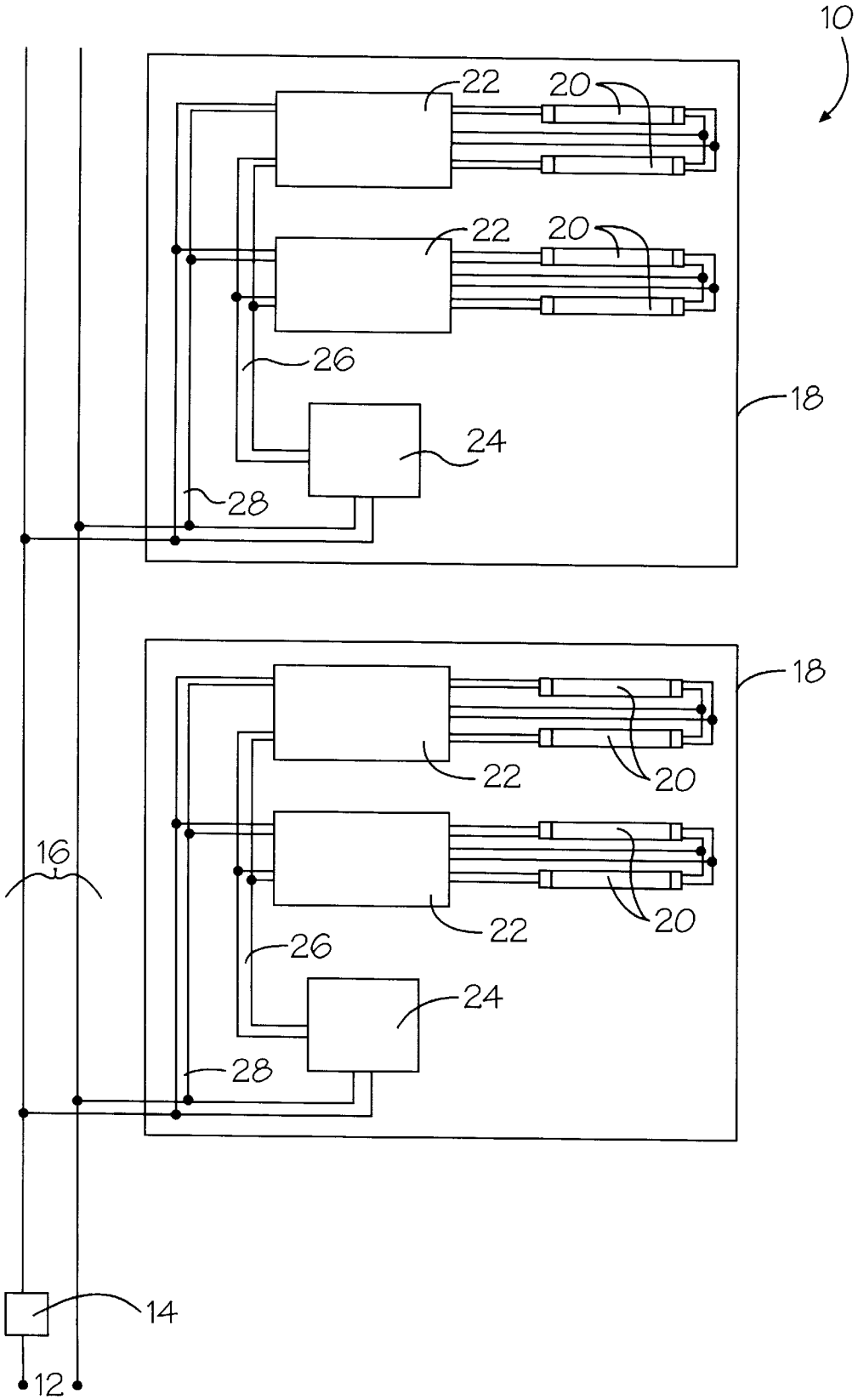
FIG. 1 is a schematic block diagram of a lighting system incorporating the control system of the present invention.

Referring now to FIG. 1, there is shown generally at reference number 10, a block diagram of a lighting system incorporating the two-wire control system of the present invention. AC power 12 is applied to lighting (dimming) controller 14 which is, in turn, connected to a two-wire lighting control circuit bus 16. Circuit bus 16 connects one or more lighting luminaires 18 that each contains lamps 20, dimmable ballasts 22, and a decoding module 24.

The decoding module 24 generates low voltage control signals 26 needed to control the ballasts 22, while power wiring 28 provides AC power to the ballasts 22. One decoding module 24 can supply control signals 26 to many ballasts 22 that may be located in nearby luminaires 18, but separate low-voltage control wiring and power wiring must be connected to each luminaire 18. The total electrical load that can be driven by lighting control module 14 is limited by its electrical, mechanical, and thermal design. A typical unit 14 may drive up to six luminaires 18, each containing two 32-watt lamps 20.

Figure 2:
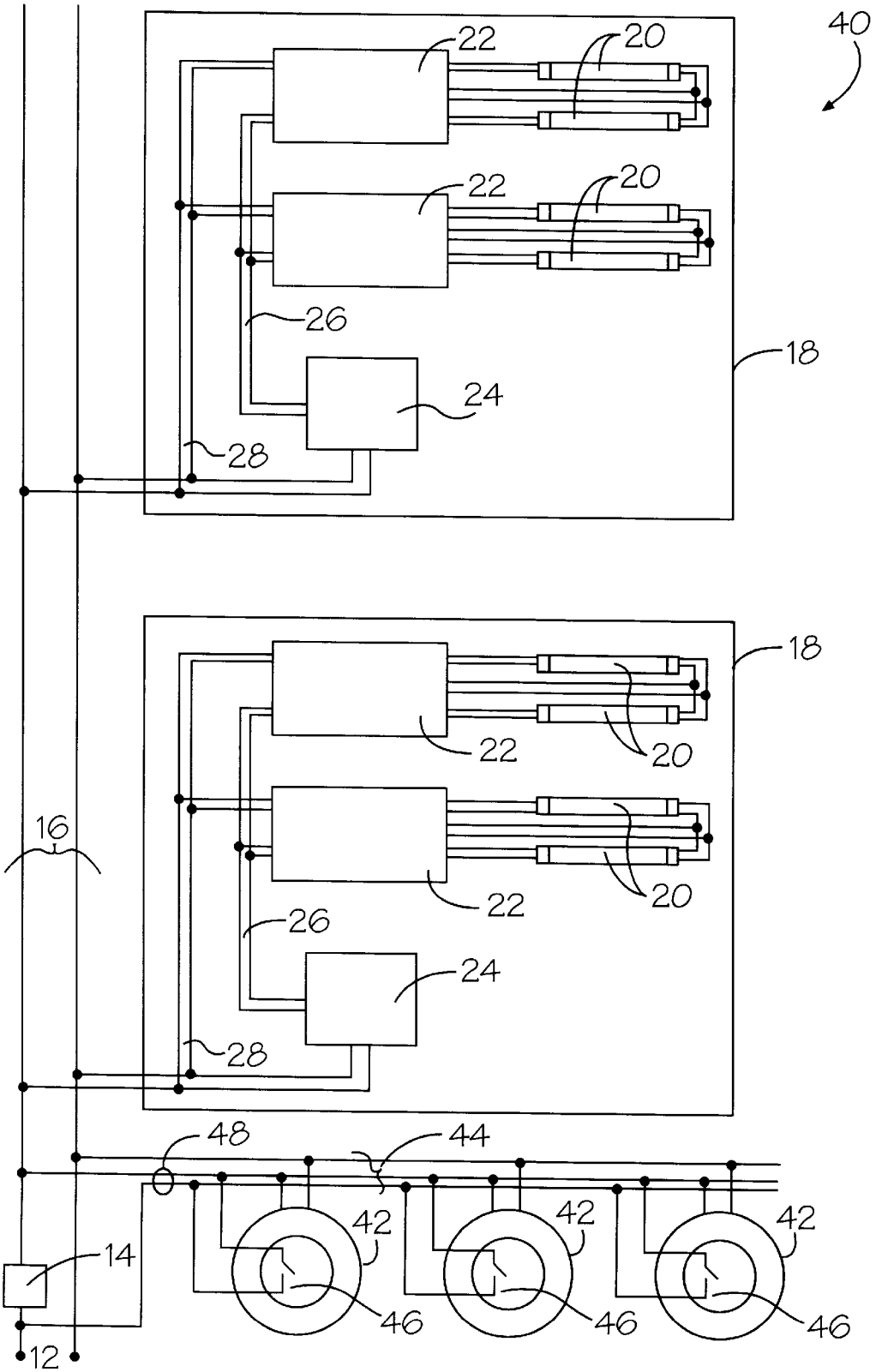
FIG. 2 is a schematic block diagram of a lighting system including room occupancy sensing.

Referring now to FIG. 2, there is shown generally at reference number 40, a block diagram of the lighting system of FIG. 1. In addition, the light level from lamps 20 in luminaires 18 is under control of a number of occupancy sensors 42 connected together with a three-wire bus 44 which connects to the two-wire lighting control circuit bus 16. When the presence of an occupant (not shown) is sensed by any of the sensors 42, indicating that a person is in the room, an associated relay contact 46 closes. The current normally flowing through dimming controller 14 is then bypassed through wiring 48 and the closed contact(s) 46. The bypassing of dimming controller 14 by contacts 46 permits full, uncontrolled AC power to be applied to the luminaires 18, which then operate at their full brightness.

If no occupant is sensed by any of the sensors 42 (i.e., no person is in the room), then after a predetermined delay, all relay contacts 46 open, and current again passes through dimming controller 14. In the embodiment chosen for purposes of disclosure, a delay in the range of approximately 1 to 10 minutes has been found satisfactory. This controller 14 adjusts the output brightness of luminaires 18, returning them to their dimmed state, in which they draw less power. The advantage to this approach is safety. The lighting system 10 may be designed so that at no time are any of the luminaires 18 completely shut off; a low lighting level always remains. This is an important concern for an installation, for example, in a public hallway. Also, this function can be easily implemented in a building in which the lighting is already installed.

Most existing wiring in buildings is similar to that shown in FIGS. 1 and 2. Luminaries 18 are supplied with AC voltage by means of two-wire lighting circuits 12. In most installations, the function of lighting controller 14 is already performed by an on/off switch. A retrofit to the dimming/ occupancy sensor architecture needs only the installation of sensors 42 and their associated wiring 44. If on/off control is required, an additional on/off switch may be added, possibly as part of lighting controller 14.

Figure 3:
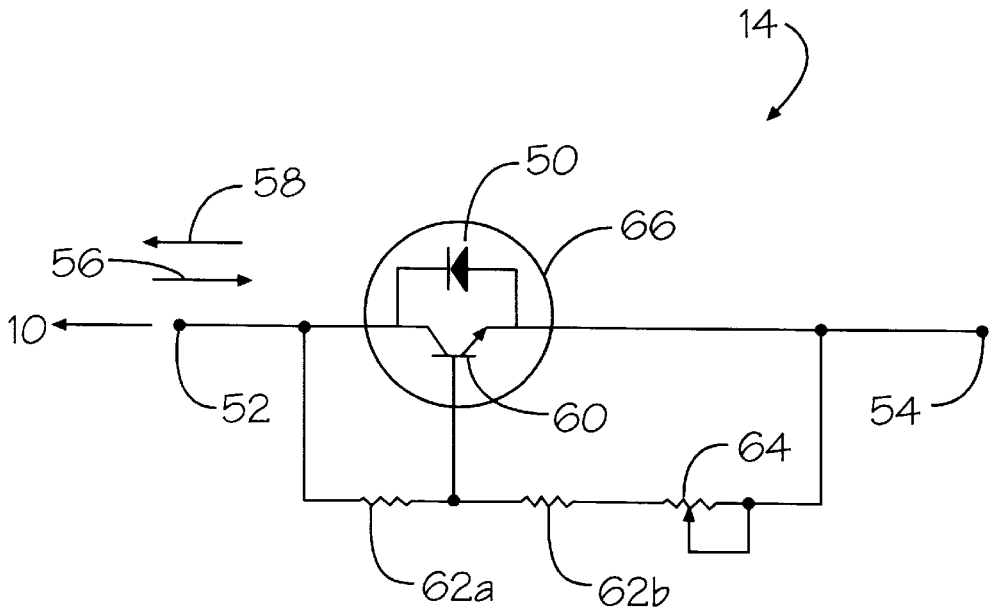
FIG. 3 is a schematic diagram of the dimming control signal generator of the present invention.

Referring now to FIG. 3, there is shown a schematic diagram of the circuit residing in lighting controller 14. The circuit consists of a variable-voltage reference multiplier circuit with a shunting bypass diode 50. This type of circuit is well known within the art and is commonly used within integrated circuit chips to provide voltage level shifting. A reference to this circuit is in BASIC INTEGRATED CIRCUIT ENGINEERING, by D. J. Hamilton and W. G. Howard, McGraw-Hill, 1975, pp. 314–316.

In operation, node 52 is connected to the AC supply line side input 10 (FIGS. 1 and 2) and node 54 is connected to the load side 12. During the half cycle when node 52 is driven in the positive direction and current flow results along arrow 56, the multiplier circuit becomes active and forces a constant voltage drop across transistor 60. The amount of voltage drop is set by the dividing ratio of resistors 62*a*, 62*b* and 64. The circuit sets the voltage drop so that the base emitter voltage of transistor 60 remains at a constant value. During the half cycle when node 52 is driven in the negative direction and current flow results along arrow 58, current passes through bypass diode 50, contained inside the case 66. The voltage drop when current flows in this direction (arrow 58) is much lower than the voltage drop which occurs when current flows in the first, opposite direction (arrow 56). Thus, the controller circuit 14 forces a slight asymmetry to the output voltage waveform as observed at node 54. A decoding unit 80 (FIG. 5), generally placed within a luminaire 18, generates a DC dimming control voltage from this induced voltage waveform asymmetry, as described in detail hereinbelow.

Figure 4:
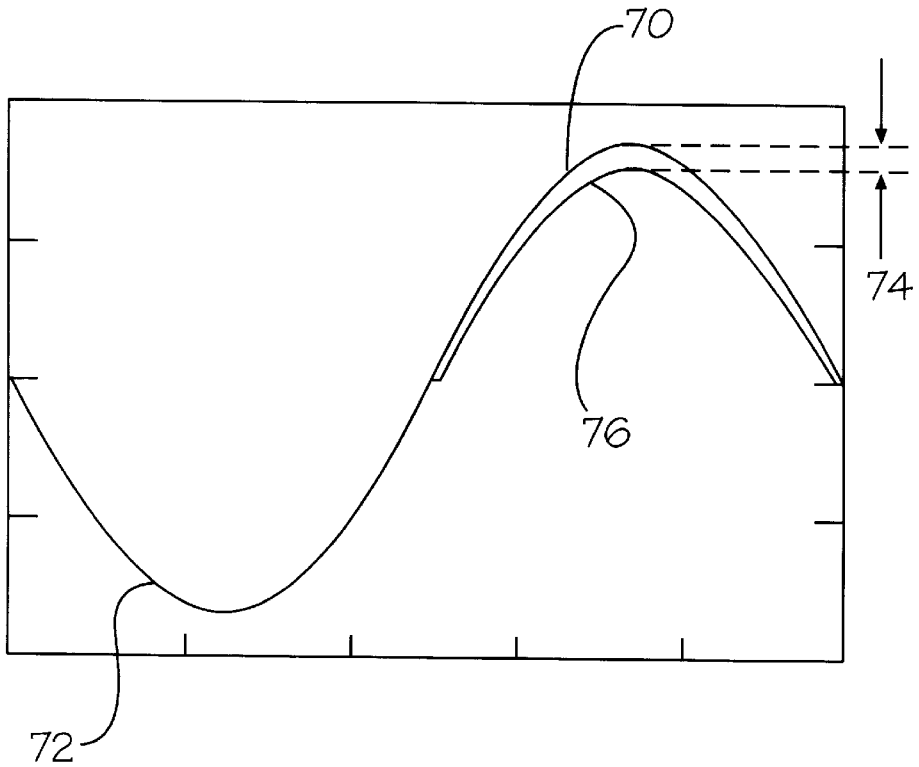
FIG. 4 is a single cycle of AC power showing the imposed DC offset used for control signal transmission.

Referring now to FIG. 4, the voltage waveform asymmetry created by the controller circuit 14 of FIG. 3 is shown. A normal voltage waveform has symmetrical positive 70 and negative 72 half cycles. When in a dimmed state, controller circuit 14 introduces an asymmetry so that positive half cycle 70 is reduced by a voltage offset 74 to half cycle 76. This reduction and the associated voltage drop across controller 14 causes a dissipative power loss in controller 14. By arranging the polarities so that the maximum voltage drop is associated with the dimmed state, the maximum voltage drop occurs with the minimum current. Dissipative heating in controller 14 is thereby minimized.

Figure 5:
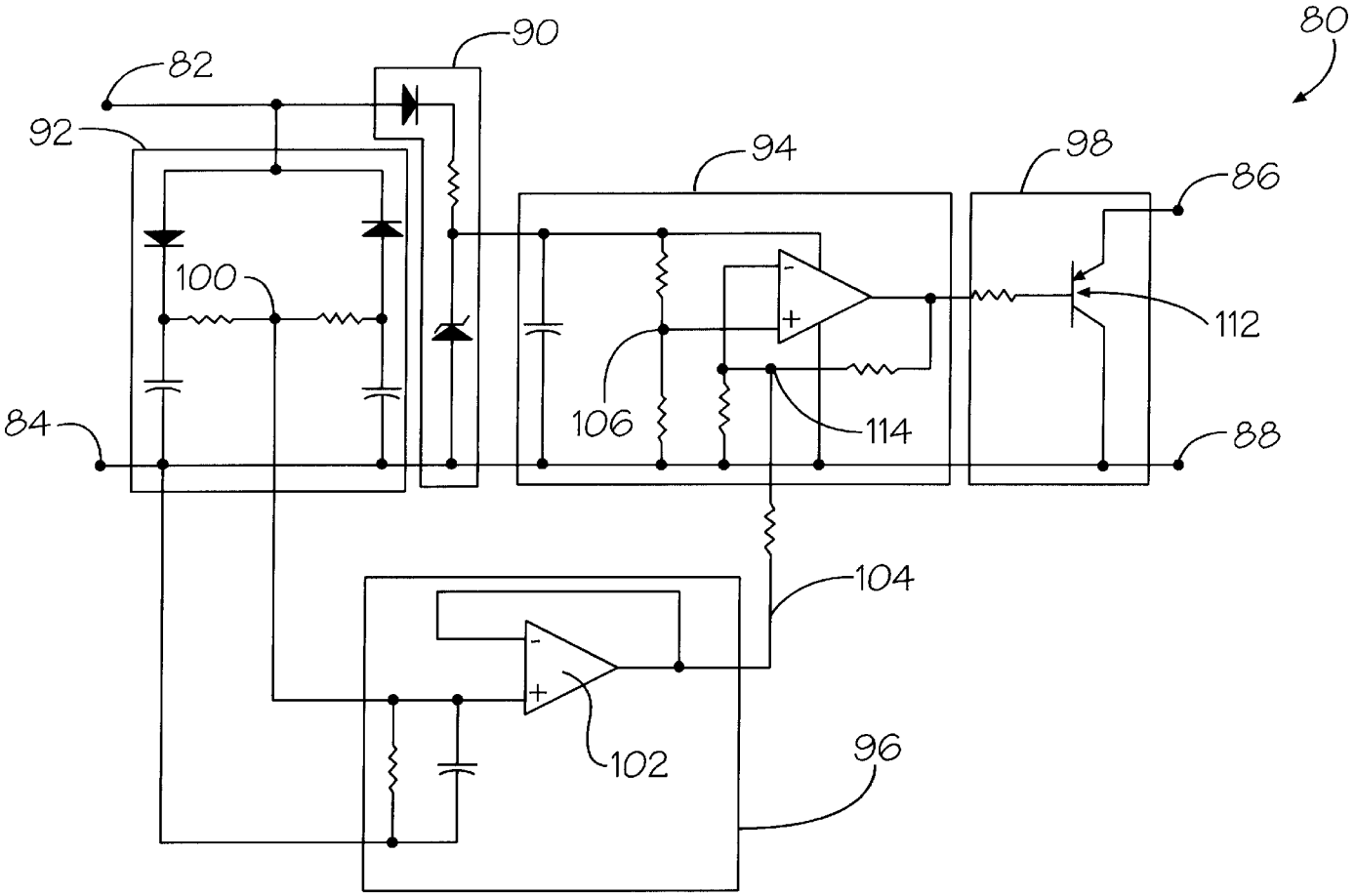
FIG. 5 is a schematic diagram of the decoding module of the present invention.

Referring now to FIG. 5, there is shown a schematic diagram of a decoding module 80 for use cooperatively with dimming controller 14. AC input power 16 (FIGS. 1 and 2) is applied to nodes 82 and 84. The low voltage control signals, generated by decoding module 80, are connected to output nodes 86 and 88. The main structural blocks of the circuit include half wave DC supply 90, dual peak detector and difference generator 92, inverting level shifter 94, voltage following buffer 96, and output voltage follower 98.

In operation the difference between the peak AC voltages in the positive and negative directions is determined in block 92 at node 100. This difference signal is filtered and buffered by block 96, which contains operational amplifier 102. The output signal 104 from block 96 is one input 114 to the inverting adder in block 94. The adder, consisting of operational amplifier 106 and its associated circuitry, level-shifts signal 104 from block 96 to form the proper voltage swing and polarity required by the dimming ballast 22.

Figure 6A:
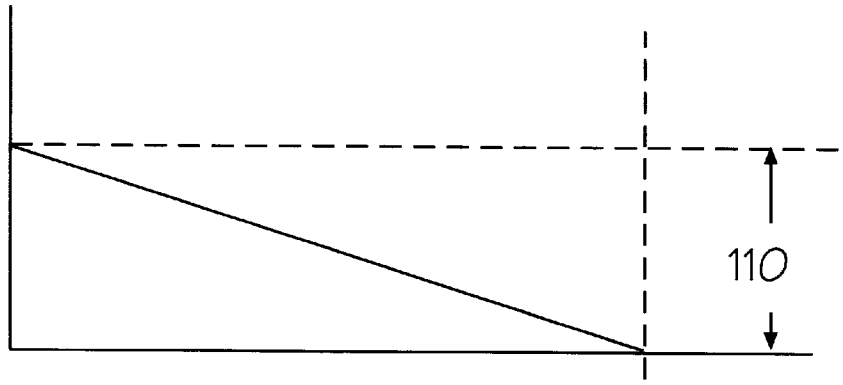
FIGS. 6*a* and 6*b* are a diagrams showing the voltage transformation of the DC offset voltage into a conventional 0–10 volt dimming control signal.
Figure 6B:
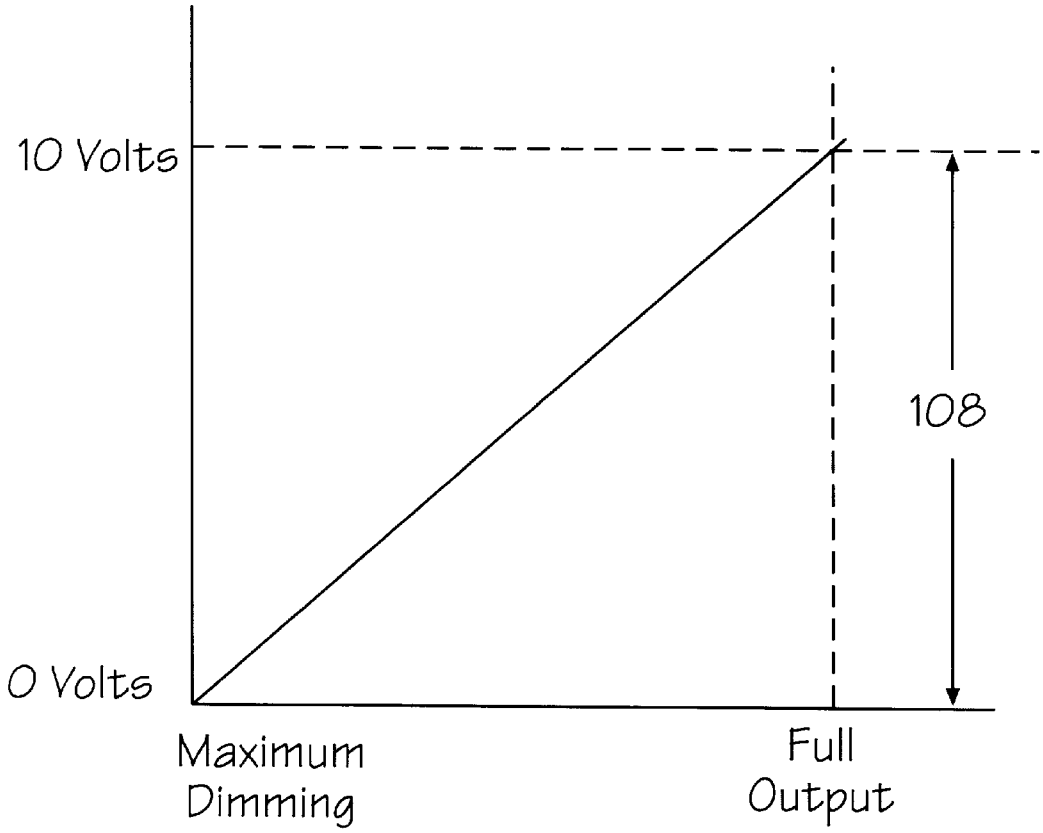

Referring now also to FIGS. 6*a* and 6*b*, there are shown diagrams illustrating the voltage transformation. Maximum dimming to full light output requires a 0–10 volt signal 108 to the ballast (FIG. 6*b*), but an inverted positive to zero swing of different magnitude (typically in the range of 2–7 volts) 110 (FIG. 6*a*) is produced at node 100. The voltage inversion and level shifting is accomplished in block 94. The control circuit of a dimming ballast 22 is a current source. Transistor 112 is configured as a voltage follower in block 98 so that the voltage between output nodes 86 and 88 corresponds to the proper dimming level, regardless of the number of ballasts connected in parallel across output nodes 86 and 88.

Figure 7:
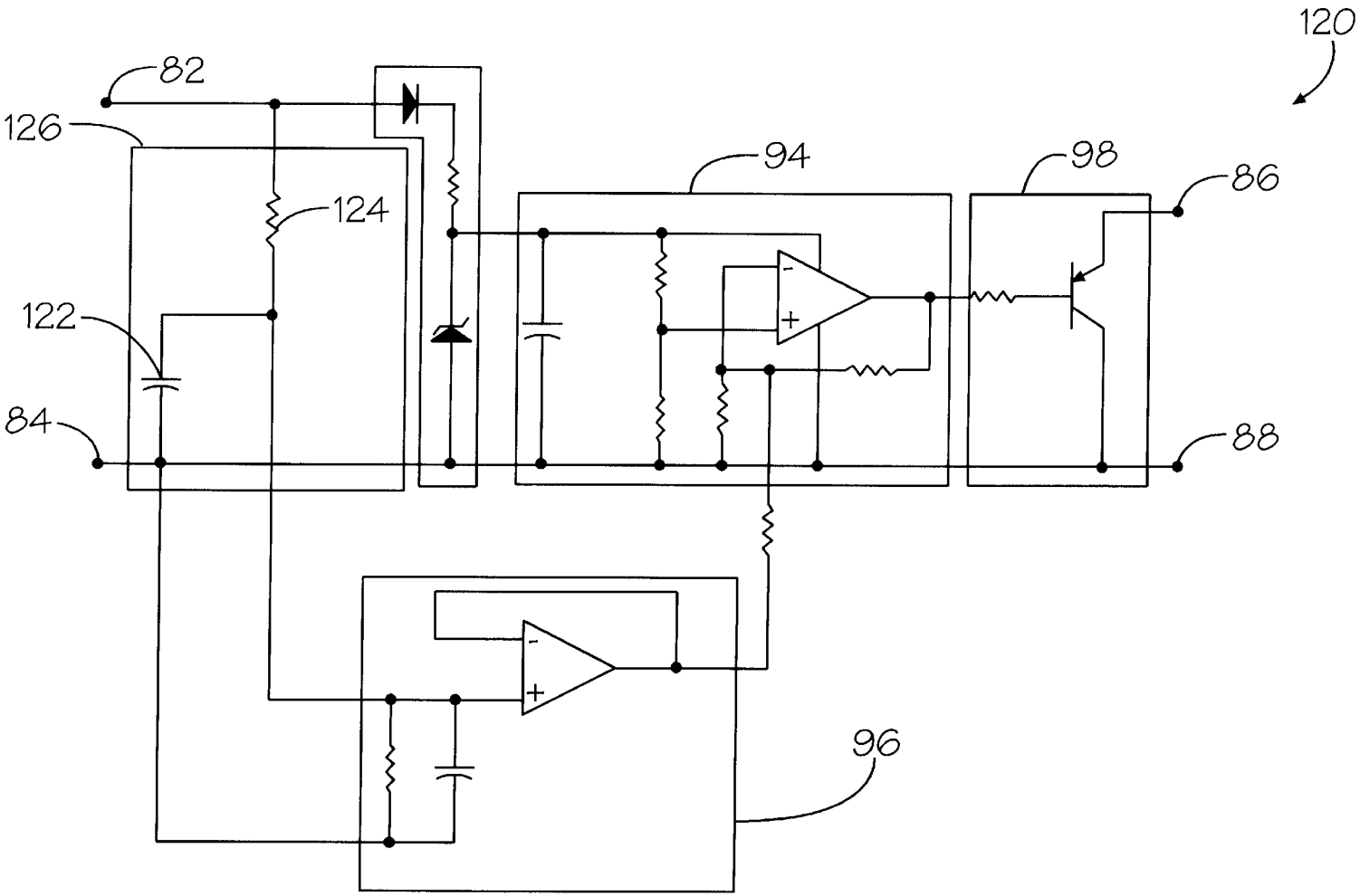
FIG. 7 is a schematic diagram of an alternate embodiment of a decoding circuit for use in the present invention.

The decoding module circuit 80 uses a differential peak detector to determine the degree of asymmetry of the waveform. An alternative approach is to average the signal with RC filtering. An example of this type of circuit is shown in FIG. 7, reference numeral 120. The averaging circuit is an RC filter (capacitor 122, resistor 124) in block 126. A lower voltage is obtained with this circuit than with the circuit of FIG. 5, but it has been proven to be less susceptible to electrical interference and thus useful in noisy electrical environments. A two-stage filter is shown in the circuit of FIG. 7. Note that the input voltage for most AC power situations is relatively free of DC since power distribution transformers do not couple DC current, and have output voltages, the average value of which is zero. It should be noted, however, that some electrical appliances use an asymmetric switching device such as a silicon controlled rectifier (SCR), which produces an asymmetric voltage drop due to electrical resistance in the AC power line. If one or more of these appliances is connected to nodes 82 and 84, the AC input nodes to decoding module 80 as described in FIGS. 5, 7 and 8, then a DC signal will be generated that may affect the dimming level of the lamps. A solution for this case will be described in an alternate embodiment to be described in detail hereinbelow with reference to FIG. 9.

The circuits of both FIGS. 5 and 7 are sensitive to the polarity of the AC power wiring connected to controller 14 and to the decoder module 80. This occurs because of the direct conversion of the controller signal to the dimming control voltage, which must be in the range of 0–10 volts only. It would be desirable to have a system which is insensitive to the polarity of connections of both the controller 14 and the decoder module 80 but which still produces a 0–10 volt signal with correct polarity.

Figure 8:
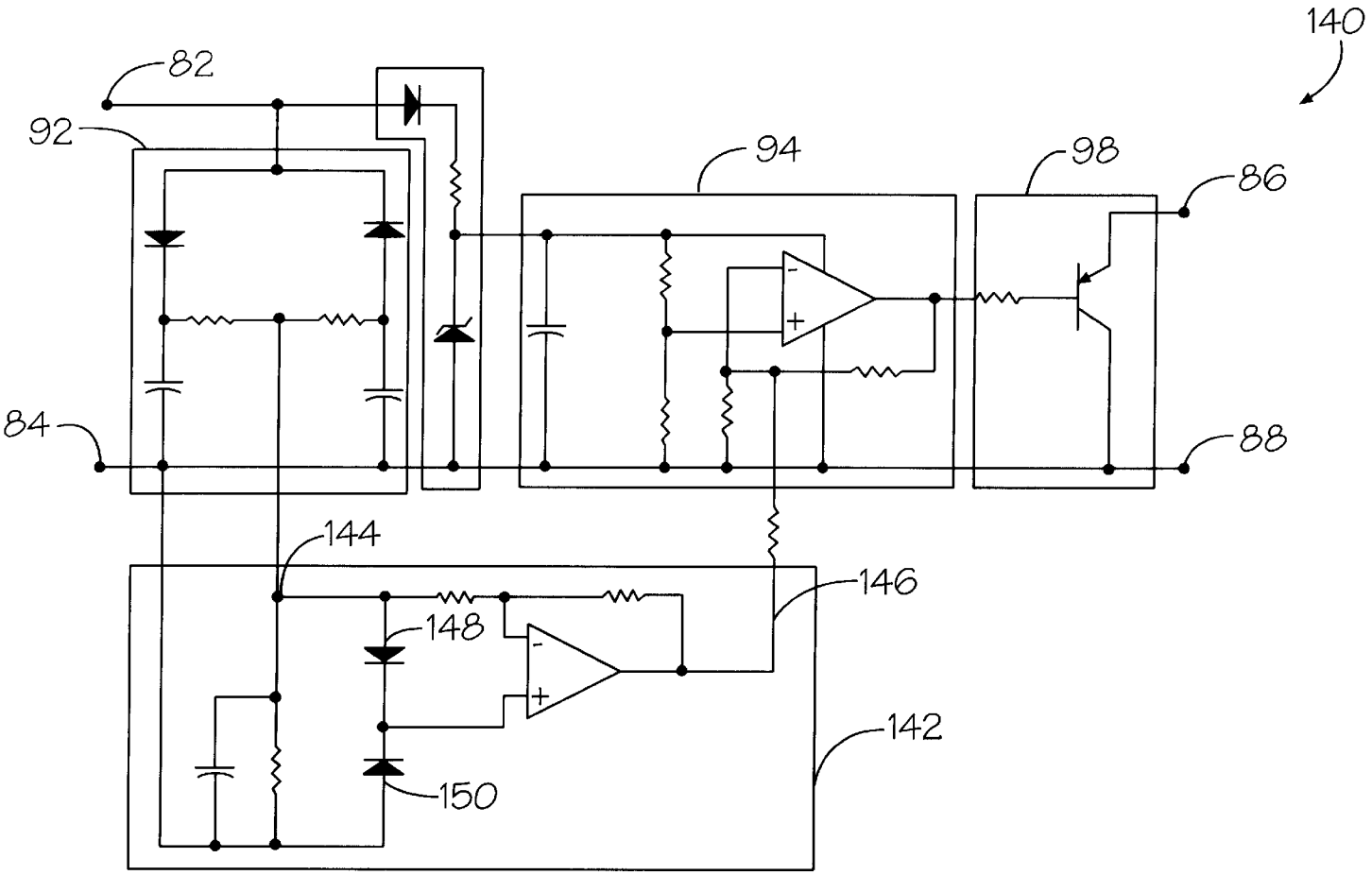
FIG. 8 is a schematic diagram of another embodiment of the present invention with a polarity-insensitive circuit.

Referring now to FIG. 8, there is shown a schematic diagram of a polarity-insensitive circuit which overcomes this difficulty. Circuit 140 uses a full wave rectifier or absolute value operational amplifier circuit 142 in a manner well known to those skilled in the circuit design art. In block 142 signals in the positive direction at input node 144 result in positive signals at the output node 146, since diode 148 conducts for positive inputs. For negative inputs at node 144, diode 148 blocks current flow while diode 150 conducts. The circuit acts as an inverting amplifier, so that negative inputs result in positive signals at output node 146.

A circuit of this type that is polarity insensitive has important practical advantages. Because of insensitivity to polarity, the lighting (dimming) controller 14 (FIG. 3) may be connected in the circuit in either of two possible ways, with either node 52 or node 54 connected to the incoming AC line. Thus, the pigtail wiring used by the electrician to connect the control can have the same coloring; which wire is used for the incoming AC line does not matter. This allows a dimming controller 14 to be installed as if it were a conventional on/off switch in which the wiring order of line side/load side is not specified. This offers a safety advantage, because a dimming controller 14 cannot inadvertently be installed in a reversed fashion. In a conventional polarity-sensitive controller, such an error might result either in a safety hazard or in damage to the controller.

There is another, more subtle advantage. A small DC and 120 Hz harmonic current is introduced into the AC line by this type of dimming controller. However, the phase of the harmonics depends on the polarity with which the controller 14 is installed in the AC line. If a great number of controllers 14 is randomly installed, the probability is high that approximately 50% of the controllers will be installed with each polarity, resulting in out-of-phase cancellation of a significant portion of the generated harmonics. In a large lighting installation where power quality and harmonic content is an important concern, such a feature may be quite important. Also, because of the signal polarities chosen, harmonics are created only at the lower dimming levels at which the AC current and its harmonic content are already low. Total harmonic distortion (THD) of the present invention has been found to be in the range of 5% and never exceeding 15%. On the other hand, conventional phase controllers typically introduce distortions greater than 50%.

Figure 9:
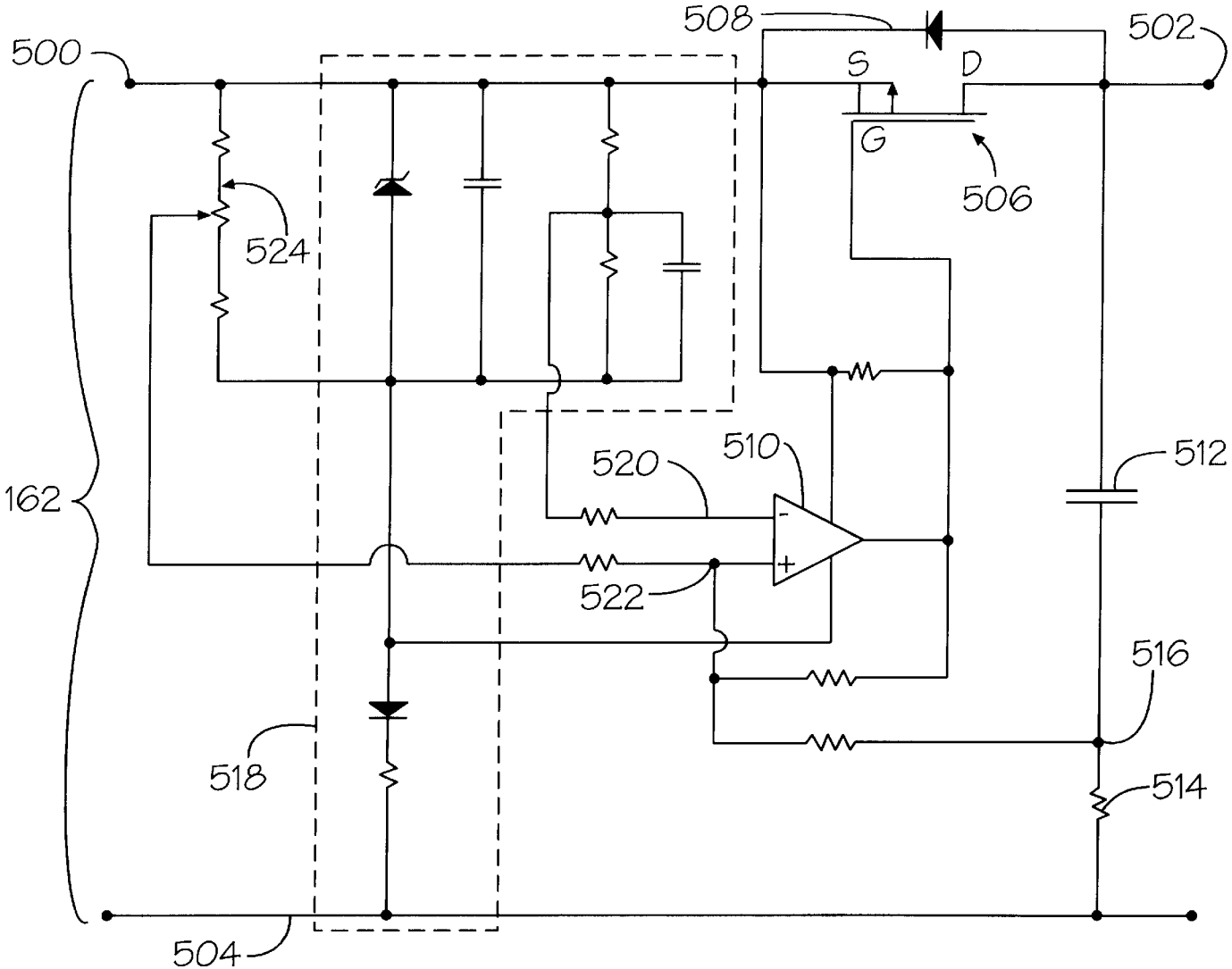
FIG. 9 is a schematic diagram of an alternate embodiment of the inventive dimming control which incorporates a regulation function to compensate for extraneous asymmetry of the AC signal.

Referring now to FIG. 9, there is shown an alternate embodiment of the dimming control. This circuit utilizes negative feedback regulating properties to correct for small residual asymmetry of the incoming AC line voltage that might otherwise disturb the dimming function. An example of such a disturbing perturbation is the asymmetry that can be introduced onto an AC line by a variable speed motorized appliance. Such appliances sometimes make use of a half-wave SCR type of variable speed control which draws power preferentially from one-half of each AC cycle. If such an appliance is plugged into the same circuit as the controlled lighting ballasts, then resistive voltage drop in the supply line can be sufficient to cause an asymmetric voltage drop which can ultimately affect the lighting levels when the motorized appliance is turned on or off. For electric circuits that consist of purely lighting devices, a regulation circuit is not required since lighting loads are symmetrical in nature. In practice, the intentional asymmetry control voltage is set so that the average of the positive and negative voltages typically varies in the range of approximately 2–10 volts, even as high as 15 volts. It has been found, however, that voltages above 15 volts lead to excessive power dissipation in the dimming controller 14. In comparison, the incoming voltage asymmetry of the power system is typically about a volt for most power systems supplying power to a small asymmetrical load. This type of incoming offset can be corrected by using a regulating circuit.

The dimming control of FIG. 9 alleviates this problem by means of such a regulation circuit. In this embodiment, input power on the "hot" AC conductor 500 of ac supply line 162 is supplied to node 500, and delivered to the load at node 502. The neutral return connection necessary to complete the circuit is not shown. Conductor 504 is the green safety ground wire and is used to provide a potential reference for the circuit, and to provide a drain for the small amount of power used by the circuit. This illustrates a standard connection method used, for instance, to connect a wall light switch to a lamp load. The regulation op-amp 510 controls p-channel MOSFET 506 to produce a small voltage drop over one half of the ac voltage waveform. Bypass diode 504 shunts the load current over the opposite half of the cycle, producing the required asymmetry. The RC circuit composed of capacitor 512 and resistor 514 are used to provide an average of the outgoing voltage waveform. The voltage at sense node 516 is a measure of the outgoing asymmetry. It is a typically few volts offset from the voltage at node 502, depending on the amount of asymmetry present. The circuitry within box 518 forms a conventional half wave power supply which provides a small amount of power for the regulator circuit.

Amplifier 510 is provided a constant reference voltage at its positive input 520, while its negative input 522 provides the summing point for the regulator circuit. By servo action, the system will attempt to keep summing point 522 at the same potential as its reference positive input 520. In doing so, the gate drive voltage will become adjusted so that sense node 516 is held at the desired offset level, a constant voltage proportional to the setting of control potentiometer 524.

The dimming controller 14 (FIGS. 1 and 2) may be implemented with many different package form factors, each of which is optimized for a particular application. For example, the dimming controller 14 can be integrated with a wall switch as part of a variable dimming control. This type of package is intended to provide a direct replacement for an on/off wall switch or an incandescent dimmer. This package would typically be used in applications where a small number of ballasts (up to six, for example) are to be dimmed and only local remote control is required. The term "local" indicates the idea that the control unit and the devices to be controlled are generally in the same room, or at least in the same general area.

Figure 10:
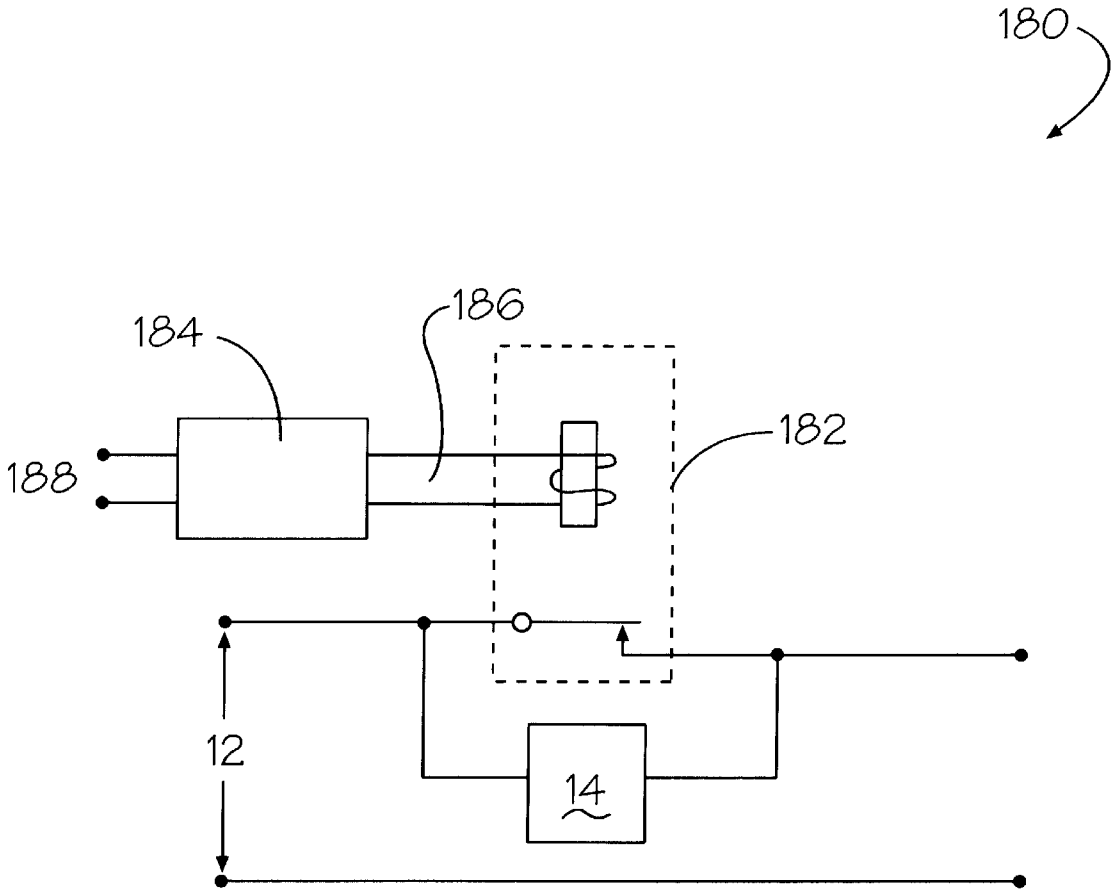
FIG. 10 is a schematic diagram of an alternate embodiment showing the control unit interfaced directly to a building control computer network.

In another case where local control is not needed or desired, the controller 14 may be interfaced to a building control computer network either directly, or through an intermediate computerized control unit. Referring now to FIG. 10, there is shown generally at reference numeral 180, a schematic diagram of such a configuration. This configuration 180 allows remote control through a direct connection to the network (not shown). AC power 12 is applied to dimming controller 14 and also to a normally open (n/o) contact of relay 182. The coil of relay 182 is connected to the output of network interface module 184 by means of interface wiring 186. The input of network interface module 184 is connected to a building control computer network through network interface nodes 188. Network interface module 184 also may have connections (not shown) that allow it to sense events through the use of sensors and to enable functions such as controlling relay 182.

In operation, the dimming control unit 180 allows lighting controller 14 to be active or to be bypassed by relay 182. This allows the building control computer to set the control signal to one of two dimming levels. It will be apparent to those skilled in the art that additional monitoring and/or controlling functions may be added to the basic dimming control circuit. Such functions include the ability: to turn off the power to the controlled devices; to provide a plurality of different dimming levels by replacing the variable resistor 64 (FIG. 3) with a digitally-controlled potentiometer (not shown) such as the Model No. DS1804 semiconductor manufactured by Dallas Semiconductor; to sense.whether the devices are actually drawing power; and to determine how much power the devices are drawing. It should be obvious that the controlled ballast itself forms a typical device for which power status monitoring is useful.

The inventive two-wire controller may be easily interfaced with building control computer networks, such as Lonworks® from Echelon Corporation of Palo Alto, Calif. and CEBus® from the Electronic Industries Association.

A hotel room is a typical example of an application that could use an intermediate computerized control unit to connect to various sensors and control functions. In this example it might be cost-prohibitive to attach every sensor and control signal in every hotel room directly to a building control computer network, but it may be highly desirable to have certain devices in each room in communication with the network. An intermediate control computer could handle "local" control functions and export certain, preselected functions to the building network computer.

Figure 11:
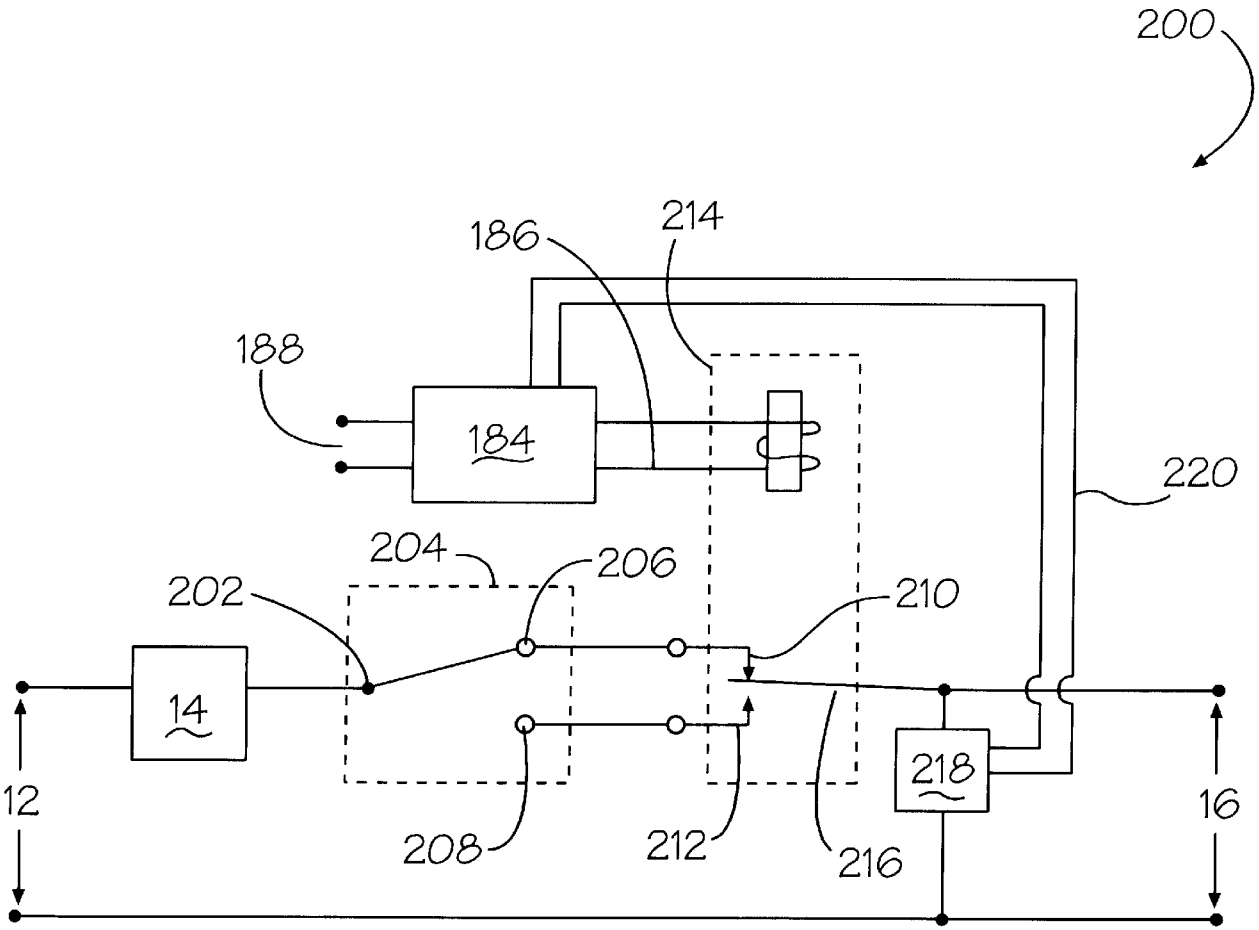
FIG. 11 is a schematic diagram of an alternate embodiment with a multi-access control unit directly interfaced to a building control computer network.

Referring now to FIG. 11, there is shown generally at reference numeral 200, a schematic diagram of another embodiment of a dimming control unit that allows local on/off as well as dimming control. It may also be interfaced to a building control computer network either directly, or through an intermediate computerized control unit. AC power 12 is applied to the input of dimming controller 14. The output of dimming controller 14 is applied to the common terminal 202 of a conventional three-way s.p.d.t. toggle switch 204. The remaining terminals 206, 208 of switch 204 are connected to contacts 210, 212 of relay 214, respectively. The common contact 216 of relay 214 provides controlled output AC power 16.

The coil of relay 214 is connected to the output of network interface module 184 by relay interface wiring 186. Network interface module 184 is connected to a building network (not shown) through network interface nodes 188. Voltage sensor 218 is connected across the controlled output power source 16 and provides an input to network interface module 184 through voltage sense interface wiring 220. Network interface module 184 allows the building control computer (not shown) to determine if power is being applied to the two-wire lighting power circuit 16 by monitoring voltage sensor 218. Relay 214 is preferably of the latching variety, since no energy is required to maintain a state once it has changed states.

Relay 214 and switch 204 act as a three-wire (three-way) circuit often found in household lighting applications where, for example, one switch may be located at the top of a stairwell while a second switch may be located at the bottom; both can control the same light. This arrangement allows either the local switch or the network to control the load. That is, the lamp may be turned on or off either locally or by the building control computer. A typical application for this type of control strategy is a conference room. During the day, people may enter and leave the room, turning the lights on or off as required. At the end of the day or at other times as required, the building network control computer ensures that the lights are turned off. If an employee happens to be working late in that room, he or she could still override the building computer with the local switch. As mentioned above, it will be apparent to those skilled in the art that additional monitoring and/or controlling functions may be added. Occupancy sensing and/or daylight sensing could also readily be added.

The two-wire control systems described so far can be used to sense a parameter at a remote device and to send the sensed parameter information back over the same AC power circuit providing power and control signals to the device, to the controller. The control unit may be configured to provide either local and/or remote (i.e., proximate a room or small area or at a remote central monitoring facility). So although the locations of the control module and the decoding module have been reversed compared to examples previously described, the heart of the invention (i.e., encoding a control signal onto an AC voltage by adding a direct current offset to at least one-half of the AC voltage and sending the information over the power line) is essentially the same. An example of the monitoring function could be to monitor the temperature inside an electronic ballast. A thermistor or similar element, which is a two-terminal device that varies its resistance with changes in temperature, located in a ballast enclosure could be used to sense the temperature in the ballast. With the addition of a small number of inexpensive components, the thermistor can be used as part of a circuit to generate an appropriate offset voltage that can be encoded onto the AC voltage and sent over the two-wire control circuit bus to a decoding module. The output of the decoding module could then be used to display the ballast temperature locally or the signal could be provided to a building control computer network such as Lonworks® for monitoring purposes.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

For example, while ballasts for gas-discharge lamps have been used for purposes of disclosure, it will be obvious to those skilled in the art that the disclosed apparatus and method of the present invention may be used to control other types of loads, including, but not limited to small motors (e.g., fans, curtains, blinds, or the like), small incandescent light loads, household appliances, low-voltage halogen lighting systems, etc.

Having thus described the invention, what is desired to be protected by Letters Patent is presented in the subsequently appended claims.

What is claimed is:

1. A remotely-controllable lighting system, comprising:

a) a power source for continuously providing a sinusoidal AC voltage to a ballast, said power source comprising control signal transmitting means for periodically superimposing a continuously-variable DC control signal upon at least one half-cycle of said sinusoidal AC voltage;

b) means for receiving said continuously-variable DC control signal from said power source, for generating a ballast control signal representative thereof, and for transmitting said ballast control signal to the ballast; and c) a luminaire comprising a gas-discharge lamp and the ballast operatively connected thereto, said ballast being operatively connected to said power source and to said means for receiving, for generating and for transmitting;

whereby said ballast responds to said ballast control signal in a predetermined manner to control light output from said gas-discharge lamp.

2. The remotely-controllable lighting system as recited in claim 1, wherein said periodic superimposition of said continuously-variable DC control signal introduces less than 15% total harmonic distortion to said sinusoidal AC voltage.

3.The remotely-controllable lighting system as recited in claim 1, further comprising polarity-insensitive means for extracting said continuously-variable DC control signal from said sinusoidal AC voltage.

4. The remotely-controllable lighting system as recited in claim 1, wherein said continuously-variable DC control signal is less than 15 volts.

5. A two-wire control system for a dimmable, electronic, fluorescent ballast, comprising:

a) means for periodically superimposing a continuously-variable DC control signal onto at least one half cycle of a sinusoidal waveform of an AC voltage to produce a composite, controlling power signal;

b) means for supplying said composite, controlling power signal to a dimmable, electronic ballast, said ballast producing an output for driving a fluorescent lamp, said ballast being adapted to vary said output; and c) means operatively connected to said dimmable, electronic ballast for extracting said continuously-variable DC control signal from said composite, controlling power signal and applying a ballast control signal representative thereof to said dimmable, electronic ballast to vary the output thereof in response to said ballast control signal.

6. The two-wire control system for a dimmable, electronic fluorescent ballast as recited in claim 5, wherein said AC voltage is supplied on a power supply bus and said means for introducing said continuously-variable DC control signal comprises a wiring device adapted for insertion between said power supply bus and said electronic, dimmable ballast.

7. The two-wire control system for a dimmable, electronic fluorescent ballast as recited in claim 6, wherein said wiring device comprises a source side connection adapted for receiving said AC voltage from said power supply bus and a load side connection adapted for connection to said electronic, dimmable ballast, whereby said composite, controlling power signal is provided at said load side connection.

8. The two-wire control system for a dimmable, electronic fluorescent ballast as recited in claim 7, wherein said source side connection and said load side connection are interchangeable.

9. An apparatus for remotely controlling a device through an AC power line, comprising:

a) a load device responsive to a control signal;

b) a power source operatively connected to said load. device for continuously providing an AC voltage to said load device, said power source comprising control signal transmitting means to periodically superimpose a continuously variable DC control signal upon said AC voltage; and c) means for receiving said control signal from said power source, for extracting said control signal, for generating a device control signal representative thereof, and for transmitting said device control signal to said load device, whereby said load device responds to said device control signal in a predetermined manner.

10. The apparatus for remotely controlling a device through an AC power line as recited in claim 9, wherein said voltage has a sinusoidal waveform.

11. The apparatus for remotely controlling a device through an AC power line as recited in claim 9, wherein said continuously-variable DC control signal is less than 15 volts.

12. The apparatus for remotely controlling a device through an AC power line as recited in claim 11, further comprising polarity-insensitive means for superimposing and extracting said control signal.

* * * * *